United States Patent [19]

Morrison et al.

[11] Patent Number: 4,633,673

[45] Date of Patent: Jan. 6, 1987

[54] EMERGENCY SHUTOFF FOR AIR CONDITIONERS

[76] Inventors: Daniel R. Morrison, 412 Warren La., Key Biscayne, Fla. 33149; Ross J. Petrie, 2518 Bimini La., Ft. Lauderdale, Fla. 33312; Kenneth D. Savage, 640 Ridgewood Rd., Key Biscayne, Fla. 33149

[21] Appl. No.: 770,411

[22] Filed: Aug. 28, 1985

Related U.S. Application Data

[63] Continuation-in-part of Ser. No. 650,536, Sep. 14, 1984, abandoned.

[51] Int. Cl.[4] ..... F25D 21/00

[52] U.S. Cl. ..... 62/129; 62/150; 62/285; 340/624

[58] Field of Search ..... 62/150, 129, 126, 125, 62/272, 285, 288, 289, 290, 291; 340/623, 624, 625; 73/307, 308, 313, 314; 137/855

[56] References Cited

U.S. PATENT DOCUMENTS

| | | | |
|---|---|---|---|
| 977,055 | 11/1910 | Turek | 340/624 X |
| 1,188,603 | 6/1916 | Amrhein | 62/129 |
| 3,185,789 | 5/1965 | Gunther | 340/624 X |
| 3,205,676 | 9/1965 | Walker et al. | 62/226 |
| 3,236,061 | 2/1966 | Wells | 62/285 |
| 3,460,168 | 8/1969 | De Bruyne | 137/855 |
| 4,037,427 | 7/1977 | Kramer | 340/622 X |

*Primary Examiner*—Harry Tanner

*Attorney, Agent, or Firm*—Dennis H. Lambert

[57] ABSTRACT

An object of this invention is to provide an emergency drain for units such as air conditioners and the like, operative to collect fluid and shut off the unit when the primary drain for the unit becomes obstructed, thus protecting against damage due to overflow of the fluid, and wherein a low pressure is produced in the drain for evacuating fluid from the drain pan of the unit. Another object is to provide a one-way valve in the drain from an air conditioner or other appliance, whereby reverse flow of air or other fluid from the drain to the unit is prevented. The emergency drain comprises a fitting (11) mounted in the drain pan (14), with a primary drain opening (16) and a secondary or emergency drain opening (17) for draining away fluid accumulated in the pan when the primary drain becomes blocked. A one-way valve (37) is provided in the drain for preventing back flow of air or other fluids from the drain to the pan, and a venturi (39) is positioned in the drain pan (14) to produce a low pressure from the flow of air circulated by the air conditioner fan. A tube (38) connects the venturi with a reservoir (22) which collects the fluid drained by the emergency drain (17), whereby the fluid is evacuated through the emergency drain.

10 Claims, 7 Drawing Figures

EMERGENCY SHUTOFF FOR AIR CONDITIONERS

This application is a continuation-in-part, of application Ser. No. 650,536, filed Sept. 14, 1984 abandoned.

TECHNICAL FIELD

This invention relates to drains for appliances, such as air conditioners. More particularly, this invention relates to an emergency shutoff for an air conditioning system, with an indicator to show when the drain pan of the air conditioner becomes full of fluid, and means to prevent continued use of the air conditioner to thereby avoid subsequent overflow of the fluid from the drain pan and therefore prevent fluid damage to the surrounding structure or floor covering.

BACKGROUND ART

Appliances such as air conditioners and the like are typically fitted with drain pans for catching accumulated fluid resulting from operation of the appliance. Such drain pans are generally provided with a drain fitting for draining the accumulated fluid away from the appliance. These drain fittings are sometimes rendered inoperative by the occlusion of the outlet due to the presence of foreign matter, such as insects, algae, etc. Some prior art devices have provided an additional drain outlet opening to remove the accumulated fluid when the primary drain outlet becomes occluded. These additional drain outlet openings essentially comprise a duplicate of the primary drain outlet, although positioned at a higher location so that they only function when the fluid level in the pan rises due to occlusion of the primary drain. Moreover, as water drains from the air conditioner pan it passes through a trap in the drain line. The water in this trap prevents air from being drawn up through the drain pipe by the air conditioner recirculation fan. When the air conditioner is not operated for a long period of time, i.e. the winter season, the water in the trap evaporates. This allows a current of air to enter the air conditioner pan through the drain opening, preventing condensate from draining properly through the drain opening. This, in turn, causes an overflow of water until the air conditioner unit cycles off and water is allowed to enter the drain and fill the trap.

Other prior art devices, such as found on room dehumidifiers, for example, have reservoirs for catching water removed from the ambient air during operation of the appliance. These devices may have a float operated switch for shutting off the appliance when the reservoir becomes full.

Examples of prior art devices are disclosed in the following U.S. Pat. Nos.: 977,055, 1,188,603, 1,907,299, 3,205,676, 3,236,061 and 3,910,061. None of these patents, whether considered singly or in combination, teach an emergency drain for air conditioners in which collected fluid is evacuated from the air conditioner drain pan when the primary drain becomes occluded, nor do they teach a one-way valve in the drain line for preventing flow of air or other fluid back through the drain and into the drain pan.

DISCLOSURE OF THE INVENTION

In accordance with the invention, a dual purpose fitting is provided which has both a primary drain outlet opening and a secondary or emergency drain outlet opening therein. The fitting is attachable to the existing drain opening in the drain pan of an air conditioner or the like, and the emergency drain outlet opening functions to drain away collected fluid from the pan whenever the primary drain opening is connected with a trap or reservoir for collecting the fluid, and a switch means associated with the trap is operative to shut off the air conditioner in response to the collected fluid. In one form of the invention, the trap or reservoir is remote from the fitting to facilitate access thereto, and in another form of the invention the trap is an integral part of the fitting. A vacuum or low pressure line is connected between the reservoir and a venturi in the air conditioner drain pan responsive to flow of air from the air conditioner fan to create a low pressure in the reservoir and thus evacuate fluid from the drain pan through the emergency drain outlet opening. According to another feature of the invention, a one-way valve is connected in the primary drain to prevent flow of air or other fluid from the drain into the air conditioner housing.

The improved drain of the invention has the advantage that water is actually positively drawn or evacuated from the drain pan when the primary drain becomes occluded or the fluid level in the drain pan otherwise reaches the emergency drain outlet opening. Additionally, the one-way valve in the drain line eliminates the need to prime the fluid trap in the drain line after a prolonged period of non-use.

BRIEF DESCRIPTION OF THE DRAWINGS

Further objects and advantages of the invention will become apparent from the following detailed description and the accompanying drawings forming a part thereof, in which like reference characters designate like parts throughout the views, and wherein.

BEST MODE FOR CARRYING OUT THE INVENTION

Figure 1:
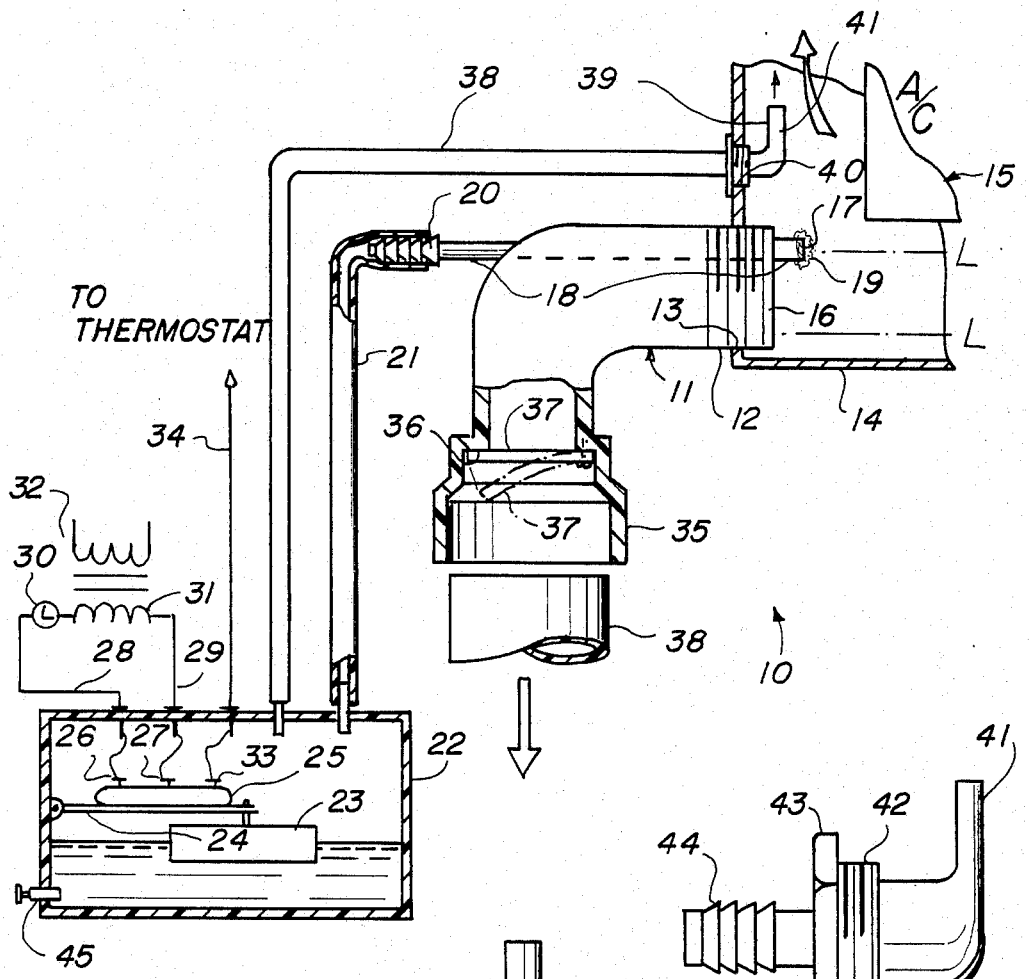
FIG. 1 is a schematic view of a first form of the invention, with parts shown in section.

Referring more specifically to the drawings, a first form of emergency drain is indicated generally at 10 in FIG. 1, and comprises a fitting 11 having a threaded end 12 engaged in the drain opening 13 in the side of a drain pan 14 of an air conditioning unit 15.

The fitting 11 is essentially elbow shaped in the form of invention shown, and at the threaded end 12 defines a primary outlet drain opening 16 for draining away fluid collected in the pan 14. Conventional primary drain fittings generally provide only a primary drain opening, and are engaged in pre-existing threaded openings 13 or other common openings in the side or bottom of the drain pan, and may be very similar to the structure thus far described. The threaded opening 13 is typically only about ¾ inch in diameter, however, and is easily occluded by insects or by the formation of algae in the pan or drain line. When this occurs, the fluid over-flows from the pan and may damage carpet, furniture, floors, etc. The fitting of the invention solves this problem by providing a secondary or emergency drain outlet opening 17 in the top portion of the primary drain opening. The outlet 17 may, for example, have a diameter of about ⅜ inch and is defined by a tubular or free-formed conduit 18 formed integrally with the fitting 11. As seen in FIG. 1, a screen 19 may be secured over the end of conduit 18 to prevent foreign matter from entering the conduit and occluding the flow of fluid therethrough.

The conduit 18 projects rearwardly from the elbow shaped fitting 11 and has a barbed end 20 for attachment thereto of a length of tubing 21.

The tubing 21 leads to a trap or reservoir 22 which collects the fluid drained away from the pan by the emergency drain opening 17. A liquid level responsive float 23 is carried by a pivot arm 24, and a mercury switch 25 is supported on the arm. First and second contacts 26 and 27 on the switch 25 are connected with leads 28 and 29 forming a loop incorporating a warning light 30 and coil of control transformer 32. A third contact 33 on switch 25 is connected with a lead 34 extending to the thermostat (not shown). Thus, as long as the float is in a lowered position, a circuit is established and power is supplied to the thermostat, enabling the air conditioner to be energized in a conventional manner. However, in the event the primary drain opening 16 becomes obstructed and the level of liquid in pan 14 rises above $L_1$ to level $L_2$, for example, the fluid will flow through emergency drain outlet opening 17 and tube 21 into reservoir 22. As the level of liquid in reservoir 22 rises, the float is carried upwardly, tilting the switch 24 and interrupting the circuit to the thermostat, shutting off the air conditioner (or other appliance) and preventing the accumulation of further liquid.

The fitting 11 has a diametrically enlarged lower end 35 shaped to provide an annular valve seat 36, and a one-way flap valve 37 is secured in the fitting for cooperation with the seat 37 to enable flow in the direction indicated by arrow A but prevent reverse flow. The one-way valve could also comprise a ball valve or any other suitable structure for one-way flow.

Figure 2:
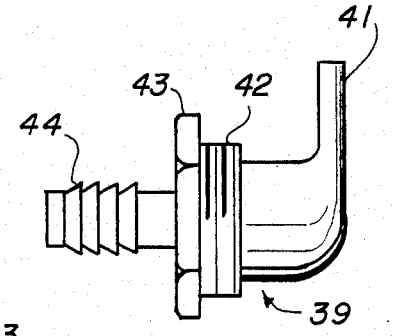
FIG. 2 is an enlarged, side view in elevation of the venturi fitting used in the low pressure line to the reservoir.
Figure 3:
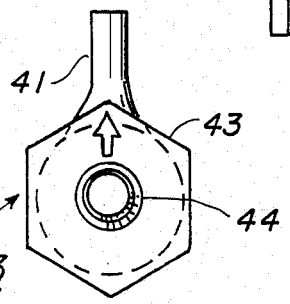
FIG. 3 is an end view, looking from the left in FIG. 2, of the fitting of FIG. 2.
Figure 4:
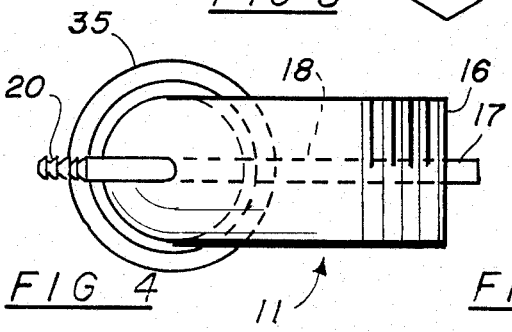
FIG. 4 is a top plan view of the drain fitting of FIG. 1.
Figure 5:
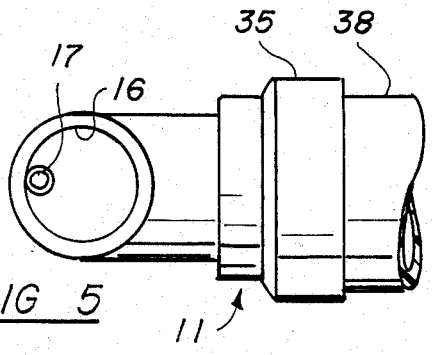
FIG. 5 is an end view, as viewed from the right hand side, of the drain fitting of FIG. 4.

A low pressure or suction tube 38 is also connected between the pan 14 and the reservoir 22. A special venturi fitting 39 is secured in an opening 40 in the drain pan and has an upturned tubular end 41 positioned in the air stream produced by the air conditioner recirculation fan (not shown), whereby a low pressure is created in the venturi fitting and in the tube 38 and thus the reservoir 22. As seen best in FIGS. 2 and 3, the fitting 39 may have a threaded portion 42 and a nut-shaped collar or flange 43 for engagement with a suitable tool. A barbed end 44 is provided for connection to the tube 38. This tube is vital to proper operation of the invention, since without the low pressure produced in the reservoir via the tube, fluid does not readily flow through the emergency drain tube 18 into the float chamber 22. However, because of the pressure differential created by the air conditioner fan, when the low pressure tube is connected the low pressure created in the reservoir actually sucks or evacuates the fluid through the emergency tube 18 into the float chamber.

A manually operated drain valve 45 is provided in the reservoir 22 to drain the fluid out of the reservoir after the main or primary drain has been cleared and the system reset.

Figure 6:
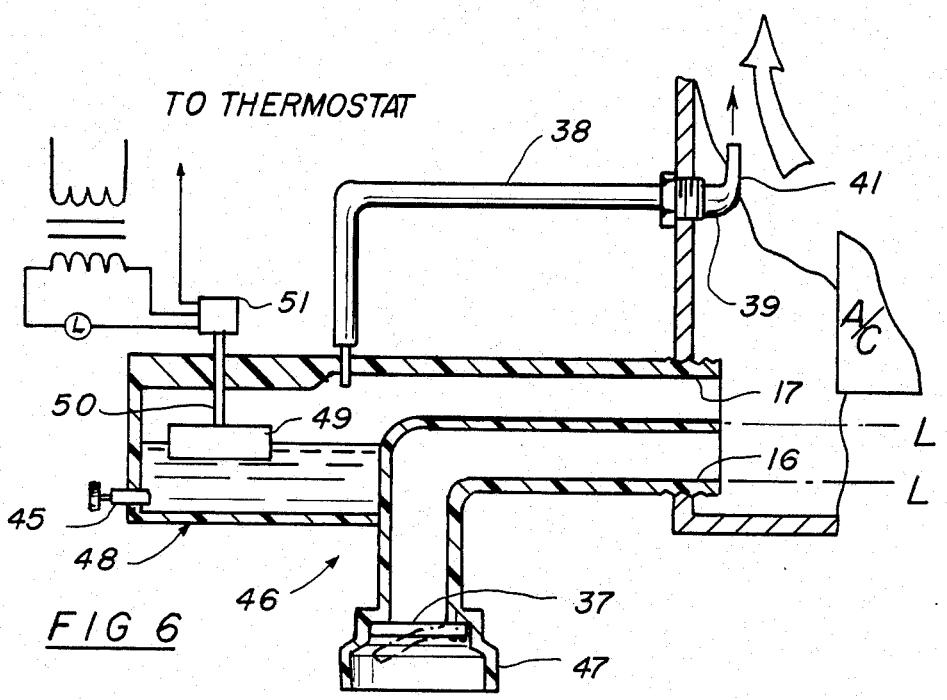
FIG. 6 is a view similar to FIG. 1, showing a modified fitting in section.

A modified drain fitting 46 is shown in FIG. 6, and comprises an integral structure having the primary and emergency drain outlet openings 16 and 17 both therein, and an outlet nipple 47 for attachment of a drain pipe (not shown) to convey the fluid to a suitable location. In contrast to the first form of the invention, however, the trap or reservoir 48 is integral with the fitting rather than remote therefrom. A float 49 is carried in the reservoir on the lower end of a switch arm 50, which extends at its upper end into a switch 51 having three contacts leading to the circuitry as previously described. Further, a manually operated drain valve 45 as previously described is provided in the reservoir 48 for draining fluid therefrom after the obstruction has been removed from the primary drain. A one-way valve 37 is also mounted in the lower end of the fitting, and a low pressure tube 38 and venturi fitting 39 are provided, as previously described.

Figure 7:
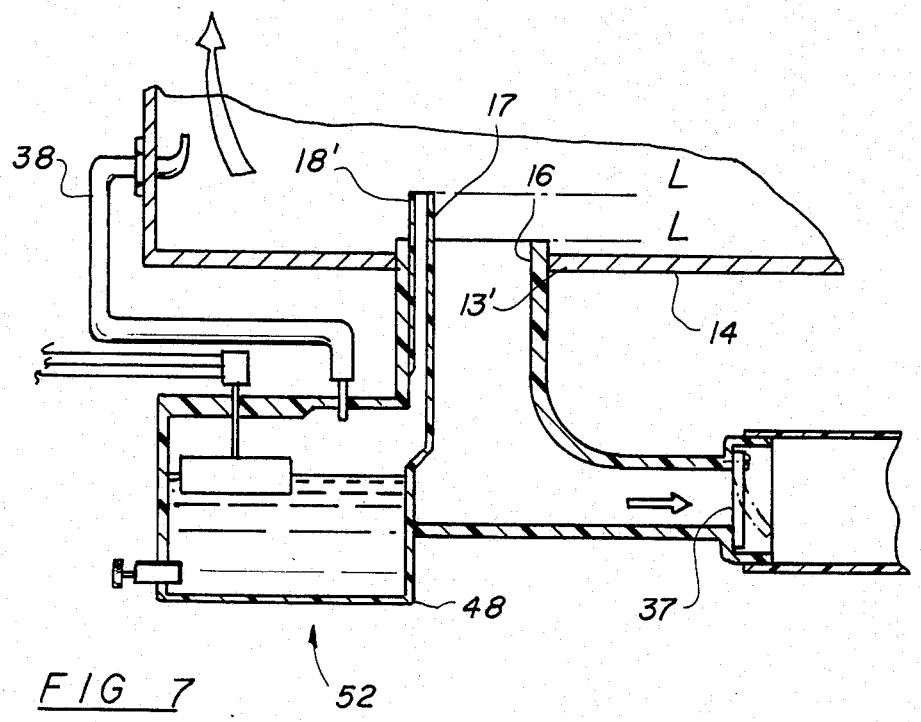
FIG. 7 is a view similar to FIG. 5 of a further modified fitting attached to the bottom of the drain pan.

A further modified drain fitting 52 is shown in FIG. 7 and is substantially identical to that shown in FIG. 6, except that the fitting is constructed to engage in a bottom opening 13' in the bottom of the pan 14, rather than in the side as shown in FIGS. 1 and 6. In this form of the invention, the tube or conduit 18' which forms the emergency drain outlet opening 17 extends upwardly beyond the end of the fitting defining the primary drain outlet opening 16, whereby fluid only flows through the emergency drain when the level of fluid in pan 14 reaches level $L_2$, caused by an obstruction in the primary drain. The conduit 18' may be cut to length as required for a particular installation.

In connection with the bottom fitting 52, it should be noted that the form of the invention shown at 11 in FIGS. 1–4 is adaptable to either a side or bottom drain opening, and the fitting 11 may simply be engaged in whichever opening is provided in a particular pan 14. As with the fitting 52, the conduit 18 may be cut to any suitable length, depending upon the requirements of a particular installation.

The fittings and/or reservoir of the invention may be made of any suitable material, such as plastic or metal, for example, and other kinds of switches may be used rather than the float actuated switches shown.

While this invention has been shown and described in detail, it is to be understood that various modifications and changes may be made in the structure thereof without departing from the spirit and scope of the invention as defined in the appended claims.

We claim:

1. In an air conditioning system having an air conditioner and a drain pan for catching fluid resulting from operation of the air conditioner, the improvement comprising:

an emergency drain and shut off for the air conditioner, including a drain fitting for attachment to a drain opening in the air conditioner drain pan;

said drain fitting having a primary drain opening for draining fluid away from the pan, and an emergency drain outlet opening for draining fluid away from the pan when the primary drain outlet opening is obstructed;

a reservoir connected to receive fluid drained through the emergency drain outlet opening;

fluid level responsive switch means in the reservoir for shutting off the air conditioner when fluid is collected in the reservoir upon obstruction of the primary drain; and means connected with the reservoir for producing a low pressure in the reservoir whereby fluid is evacuated through the emergency drain outlet opening.

2. An emergency drain and shut off as claimed in claim 1, wherein:

the fitting has an inlet end constructed to be connected in an existing drain opening in the drain pan.

3. An emergency drain and shut off as claimed in claim 2, wherein:

the fitting comprises an elbow shaped tubular body having thread means on the inlet end for threaded engagement in the drain opening of the drain pan; and said emergency drain outlet opening is defined by a tubular conduit extending within the primary drain outlet opening and having a free end normally positioned above the level of fluid in the drain pan when the primary drain is operative.

4. An emergency drain and shut off as claimed in claim 3, wherein:

the fitting is constructed to be used in either a bottom or side drain opening in the pan.

5. An emergency drain and shut off as claimed in claim 4, wherein:

the reservoir is remote from the fitting and is connected with the emergency drain via a length of tubing.

6. An emergency drain and shut off as claimed in claim 5, wherein:

the switch means comprises a float operated switch.

7. An emergency drain and shut off as claimed in claim 1, wherein:

the air conditioner has an air circulating fan; and said means for producing a low pressure in the reservoir comprises a venturi positioned in the drain pan, responsive to the air circulated by the fan to produce a low pressure, and a tube connected between the venturi and the reservoir to communicate the low pressure to the reservoir.

8. An emergency drain and shut off as claimed in claim 3, wherein:

said fitting and reservoir are formed as an integral, one-piece housing.

9. An emergency drain and shut off as claimed in claim 8, wherein:

a drain valve is in the reservoir for draining fluid therefrom.

10. An emergency drain and shut off as claimed in claim 1, wherein:

a drain valve is in the reservoir for draining fluid therefrom.

* * * * *